United States Patent [19]

Pizzurro et al.

[11] 4,420,099

[45] Dec. 13, 1983

[54] CUP-SHAPED ACTUATOR FOR AEROSOL DISPENSER

[75] Inventors: Joseph C. Pizzurro, Scarsdale; Virgil Naku, Hawthorne, both of N.Y.

[73] Assignee: Precision Valve Corporation, Yonkers, N.Y.

[21] Appl. No.: 272,122

[22] Filed: Jun. 10, 1981

[51] Int. Cl.[3] ..... B67D 5/06; G01F 11/20

[52] U.S. Cl. ..... 222/205; 222/402.12; 222/402.13; 222/182

[58] Field of Search ..... 222/402.11, 402.1, 402.12, 222/402.13, 205, 182

[56] References Cited

U.S. PATENT DOCUMENTS

| | | | |
|---|---|---|---|
| D. 230,472 | 2/1974 | Hayes | D9/258 |
| D. 238,855 | 2/1976 | Hayes | D9/258 |
| D. 242,226 | 11/1976 | Lonegren | D9/258 |
| 2,612,293 | 9/1952 | Michel | 222/182 |
| 2,671,578 | 3/1954 | McBean | 222/95 |
| 2,707,968 | 5/1955 | Efford | 137/382 |
| 2,821,048 | 1/1958 | Efford et al. | 47/1 |
| 2,831,613 | 4/1958 | Soffer | 222/182 |
| 2,883,089 | 4/1959 | Kiraly | 222/394 |
| 2,907,358 | 10/1959 | Armstrong | 141/360 |
| 2,908,479 | 10/1959 | Goodspeed, Jr. | 251/320 |
| 2,913,749 | 11/1959 | Ayres | 15/139 |
| 2,961,128 | 11/1960 | Cochran | 222/182 |
| 2,963,265 | 12/1960 | Goodspeed, Jr. | 251/320 |
| 2,973,114 | 2/1961 | Patton | 220/42 |
| 2,973,123 | 2/1961 | Rousset | 222/394 |
| 2,981,446 | 4/1961 | Campbell | 222/394 |
| 3,001,524 | 9/1961 | Maison et al. | 128/173 |
| 3,012,555 | 12/1961 | Meshberg | 128/203 |
| 3,107,033 | 10/1963 | Sanborn | 222/41 |
| 3,144,175 | 8/1964 | O'Donnell | 222/182 |
| 3,203,454 | 8/1965 | Micallef | 141/113 |
| 3,223,332 | 12/1965 | Nyden | 239/492 |
| 3,224,645 | 12/1965 | Frost | 222/182 |
| 3,228,567 | 1/1966 | Abplanalp | 222/157 |
| 3,235,132 | 2/1966 | Patton et al. | 222/182 |
| 3,236,421 | 2/1966 | Glazier | 222/182 |
| 3,301,444 | 1/1967 | Wittke | 222/402.20 |
| 3,306,252 | 2/1967 | Knight et al. | 118/3 |
| 3,358,882 | 12/1967 | Mathison | 222/80 |
| 3,410,492 | 11/1968 | Douglas et al. | 239/573 |
| 3,426,949 | 2/1969 | James | 222/499 |
| 3,446,478 | 5/1969 | Beard, Jr. et al. | 251/297 |
| 3,456,851 | 7/1969 | Mattes et al. | 222/205 |
| 3,464,593 | 9/1969 | Abplanalp | 222/182 |
| 3,494,510 | 2/1970 | Rahn | 222/153 |
| 3,606,966 | 9/1971 | Rait | 222/402.11 |
| 3,726,444 | 4/1973 | Ostrowsky et al. | 222/402.11 |
| 3,729,119 | 4/1973 | Sette et al. | 222/153 |
| 3,729,120 | 4/1973 | Sette et al. | 222/153 |
| 3,741,445 | 6/1973 | Green | 222/397 |
| 3,744,678 | 6/1973 | Beres et al. | 222/402.13 |
| 3,770,170 | 11/1973 | Hayes | 222/402.11 |
| 3,792,802 | 2/1974 | Gores | 222/402.13 |
| 3,841,532 | 10/1974 | Gores | 222/205 |
| 3,865,283 | 2/1975 | Hayes | 222/402.11 |
| 3,887,115 | 6/1975 | Petterson | 222/402.13 |
| 3,917,127 | 11/1975 | Berenstain | 222/402.13 |
| 3,934,751 | 1/1976 | Green et al. | 222/182 |
| 3,946,912 | 3/1976 | Landsman et al. | 222/402.13 |
| 3,955,716 | 5/1976 | Goncalves | 222/153 |
| 3,963,152 | 6/1976 | Landsman et al. | 222/402.13 |
| 4,034,427 | 7/1977 | Breznock et al. | 4/255 |
| 4,077,542 | 3/1978 | Petterson | 222/70 |
| 4,087,022 | 5/1978 | Zanetti-Streccia | 222/183 |
| 4,126,273 | 11/1978 | Smrt | 239/579 |
| 4,226,340 | 10/1980 | Troesch | 222/183 |

FOREIGN PATENT DOCUMENTS

| | | |
|---|---|---|
| 222248 | 10/1958 | Australia . |
| 978912 | 12/1975 | Canada . |
| 1075054 | 2/1960 | Fed. Rep. of Germany . |
| 1457462 | 5/1969 | Fed. Rep. of Germany . |
| 1750025 | 12/1970 | Fed. Rep. of Germany . |
| 2034842 | 1/1972 | Fed. Rep. of Germany . |
| 1204554 | 1/1960 | France . |
| 1213348 | 3/1960 | France . |
| 1220570 | 5/1960 | France . |
| 1418921 | 10/1965 | France . |
| 424662 | 5/1967 | Switzerland . |
| 839775 | 6/1960 | United Kingdom . |
| 2031525 | 4/1980 | United Kingdom . |

*Primary Examiner*—Robert B. Reeves
*Assistant Examiner*—Russell D. Stormer
*Attorney, Agent, or Firm*—Davis, Hoxie, Faithfull & Hapgood

[57] ABSTRACT

A cup-shaped, doubled-walled actuator for a pressurized aerosol dispenser for the dispensing of a foam product as a wad or pad including providing a venting path through the cup-shaped surface of the actuator, through the space defined by the cup-shaped surface and an outer cylindrical wall and beneath the outer wall to the outside of the container when the actuator is mounted in position on the container. An inner cylindrical wall suitable for affixing the actuator to the outside of the bead formed by the mouth of the container and the mounting cup resiliently urges the actuator toward valve closure.

4 Claims, 2 Drawing Figures

CUP-SHAPED ACTUATOR FOR AEROSOL DISPENSER

BACKGROUND

Aerosol dispensed foams and lathers have been used for many years. Recently synthetic cotton materials have been developed which permit the generation of an aseptic cotton substitute upon demand. These materials and dispenser containers are disclosed in the following patents: Beres et al. U.S. Pat. No. 3,744,678; Hayes U.S. Pat. No. 3,770,170; Hayes U.S. Pat. No. 3,865,283; Hayes U.S. Pat. No. Des. 230,472; and Hayes U.S. Pat. No. Des. 238,855.

BRIEF DESCRIPTION OF THE INVENTION

The present invention is directed to an actuator device for effecting actuation of the valve of a pressurized aerosol container filled with material for generating foam or synthetic cottom which is to be formed as wads or pads. The actuator includes a cup-shaped receptacle in communication with a dispenser orifice to promote the formation of a wad or ball of synthetic cotton or foam and includes novel means for affixing the actuator to the container and for venting propellant gas from the receptacle.

DESCRIPTION OF THE PREFERRED EMBODIMENT

Figure 1:
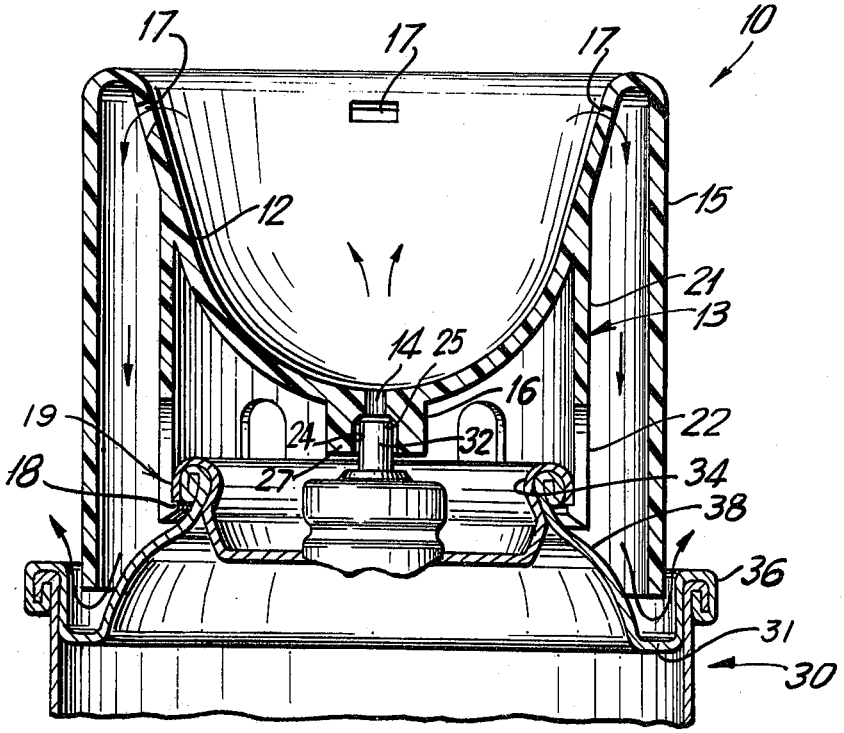
FIG. 1 is a partial sectional of the actuator cap of this invention and a valved aerosol container for use therewith.

FIG. 1 is a view in cross-section of an actuator cap, generally designated as 10, in accordance with the present invention, and wherein the cap is in the non-activated position. The actuator cap 10 is shown in place on a pressurized aerosol container, generally designated as 30. The actuator cap includes a cup-shaped top portion 12, having an orifice 14 in the bottom of the top portion, which orifice 14 is in communication with a valve stem receiving socket 16 on the underside of the top portion 12. Additionally, the actuator 10 has two cylindrical shells, inner shell 13 and outer shell 15, which shells align, as hereafter described, with the mounting cup-container bead 19 and the outer bead of the container 30, respectively. The actuator 10 is positioned on the container 30 such that the valve stem 32 of the container extends into the socket 16 of the actuator.

As mentioned above, the actuator 10 has inner and outer shells, 13 and 15, respectively. Inner shell 13 is configured such that it has an upper continous annular portion 21 and a lower slotted portion 22; said lower portion 22 having an inwardly-directed lip portion 18. The diameter of the inner shell 13 is dimensioned such that the lip portion 18 snaps over and below the rim 34 of a conventional valve mounting cup-container joinder, thereby affixing the actuator 10 to the container 30.

The outer cylindrical wall 15 is generally coaxial with the inner shell 13 and provides a finished appearance to the assembly of actuator cap and container. Note however, that the outer wall terminates within the interior of the double seam 36 which joins the top dome 38 to the sidewall of the container and is dimensioned such that upon actuation the wall 15 does not bottom onto the bottom portion 31 of the dome 38. Alternatively, the outer wall 15 may be made larger in diameter to fit outside the seam 36, however a clearance must be provided between the seam 36 and the inner surface of shell 15.

A series of vent apertures 17 are provided near the upper rim of the cup-shaped receptacle to vent propellant gas from the cup as the wad or pad of foam or synthetic cotton is generated. The vent apertures 17 communicate with the space between the inner 13 and outer 15 walls. Arrows indicate the path of the vented gas. To assure free escape for the gas, the lower margin of the outer wall can be slotted or scalloped to prevent a seal if the lower margin abuts the dome 34 on the double seam 36 of the container. Apertures can also be formed elsewhere in the outer wall 15. By venting the gas interior of the cap, rather than over the rim of the cup, the user is not subjected to or normally even aware of the flow of gas. The prior art designs represented by the above listed patents cause gas to flow between the user's hand and the rim of the cup. This is objected to by some users.

The actuator cap 10 of the present invention is brought into operation by pushing down on the upper rim with a hand. The lower portion of inner shell 13 bears against the dome 38 of the container and splays radially outwardly. The downward motion of the actuator 10 forces the valve stem 32 of the container 30 downwardly to open the dispenser valve. The synthetic cotton or foam material flows upwardly of the hollow stem and through orifice 14 to form a wad or pad of synthetic cotton or foam in the cup 12. The user's palm seals off the upper rim of the actuator cap as the cup is being filled. Vent apertures 17 near the rim serve to vent off air and propellant gas which escapes from the forming pad of synthetic cotton. The gas travels between the inner and outer walls 13 and 15 and escapes to the atmosphere. Upon completion of actuation, the resilience of the material of the lower margin of the splayed inner shell provides an upward restorative force for the actuator 10. This upward force acts together with the upward spring bias of the valve stem 32 to assure prompt closure of the valve and termination of product flow.

For certain applications, it is desirable that the mounting and locking of the actuator 10 onto the container 30 not be accompanied by a depression or actuator of the valve and pre-release of the container contents. To accomplish this end, the interfit and structural configuration of the recess of the stem-receiving socket 16 and the valve stem 32 is arranged as shown in FIG. 1; and shown in more detail in FIG. 2 in the actuated position.

Figure 2:
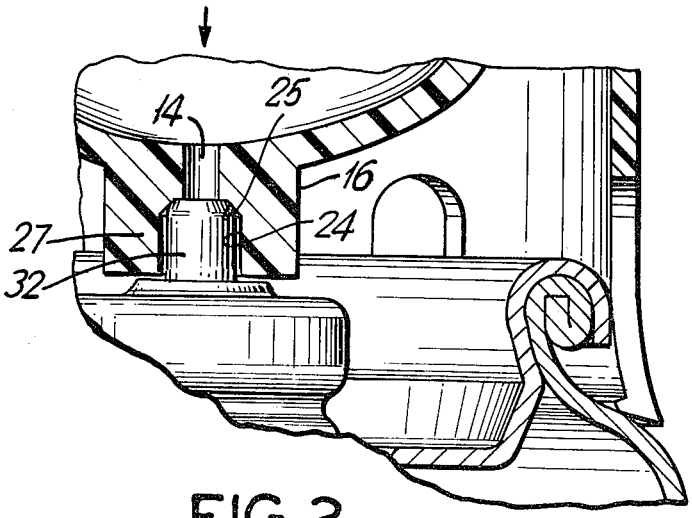
FIG. 2 is a partial sectional of the valve stem receiving socket of the actuator of this invention.

As shown in FIG. 2, the recess 24 of the stem-receiving socket 16 is slightly chamfered by providing the annular sloping shoulder 25 in the recess 24. The cylindrical wall portion 27 of the recess 24 is dimensioned such that when the actuator 10 is in a non-actuated position, that is, the lip portion 18 abuts the underside of the rim 34 (position shown in FIG. 1), the top of the valve stem 32 is not fully seated in the recess 24. Optimally, the top of the valve stem during non-actuation is contiguous to the widest diameter of the shoulder 25. Moreover, the diameter of the valve stem 32 and the diameter of the cylindrical wall portion 27 of the recess 24 are such that the valve stem 32 may pass into the cylindrical wall portion 27 of the recess 24 without frictional engagement and depression of the valve stem during mounting and locking of the actuator 10 to the container 30. During actuation as shown in FIG. 2, the valve stem 32 engages the shoulder 25 and thereby provides a seal between the sloping shoulder 25 of the recess 24 and the stem 32. Upon release of the valve actuating pressure, the actuator 10 is unseated from recess 24 as shown in FIG. 1.

We claim:

1. In an actuator for a pressurized aerosol dispenser which comprises a one-piece actuator body having a generally cylindrical outer wall, a cup-shaped portion having an upper edge defining a cup-shaped receptacle open at the top, the facing surfaces of said cylindrical outer wall and cup-shaped member defining an inner space, a discharge orifice near the bottom of the cup-shaped receptacle, a socket on the underside of the discharge orifice adapted to receive the hollow valve stem of a pressurized aerosol container, said socket having an opening communicating at one end with the discharge orifice of the actuator and at the other end with the hollow valve stem, the improvement comprising at least one vent aperture disposed in the surface defining the cup-shaped receptacle, which vent is disposed beneath the upper edge of the actuator and provides a passage from the cup-shaped receptacle to the inner space for propellant gas to escape from the product, said actuator being further adapted to vent the gas from the inner space.

2. The actuator of claim 1 wherein the actuator body also includes a generally cylindrical inner shell having a plurality of flexible portions concentric with the sidewall, the flexible portions of the inner shell including means to lock the actuator on the outside of the bead formed between the shoulder closure of the container and the valve-bearing container closure to hold the actuator on the dispenser.

3. The actuator of claim 1 and further wherein the valve stem receiving socket is dimensioned so as to receive the valve stem without actuation of the valve during mounting of the actuator on the container.

4. The actuator of claim 1, and further comprising adapting the actuator to vent the propellant gas beneath the outer cylindrical side wall.

* * * * *